US005261165A

United States Patent [19]

Tate

[11] Patent Number: 5,261,165

[45] Date of Patent: Nov. 16, 1993

[54] DRYING METHOD AND DEVICE FOR COATED LAYER

[76] Inventor: Setsuo Tate, 21-3, Kasuga-2-chome, Bunkyo-ku, Tokyo, Japan

[21] Appl. No.: 792,396

[22] Filed: Nov. 15, 1991

[30] Foreign Application Priority Data

Nov. 16, 1990 [JP] Japan ..... 2-310916
Aug. 27, 1991 [JP] Japan ..... 3-240659

[51] Int. Cl.[5] ..... F26B 3/34

[52] U.S. Cl. ..... 34/1 W; 34/39; 34/68; 34/1 X; 427/542

[58] Field of Search ..... 34/1 W, 1 X, 41, 68, 34/18, 39; 427/55, 372.2

[56] References Cited

U.S. PATENT DOCUMENTS

| | | | |
|---|---|---|---|
| 2,989,418 | 6/1961 | Harbaugh | 427/55 |
| 3,265,525 | 8/1966 | Lichte | 427/55 |
| 4,293,508 | 10/1981 | Heirbaut et al. | 427/55 |
| 4,390,564 | 6/1983 | Kimble | 427/55 |
| 4,535,548 | 8/1985 | Hyde | 427/55 |
| 4,863,375 | 9/1989 | Wu | 432/121 |

FOREIGN PATENT DOCUMENTS

| | | |
|---|---|---|
| 1-151873 | 10/1989 | Japan . |
| 2-43217 | 3/1990 | Japan . |

OTHER PUBLICATIONS

"Coating Technique", Oct. 20, 1990, published by K. K. Rikoh Shuppan (Science and Technology Company Inc.), pp. 211-213.

*Primary Examiner*—Henry A. Bennet
*Assistant Examiner*—Denise L. Gromada
*Attorney, Agent, or Firm*—Foley & Lardner

[57] ABSTRACT

A drying method and a device employs each apply to a substrate having a coated layer thereon, a first infrared radiation which has a high transmissivity relatively to the coated layer and a high absorptivity relative to the substrate, and a second infrared radiation which has a high absorptivity relative to the coated layer. The first infrared radiation is applied to the coated layer on the substrate and the second infrared radiation is subsequently applied. The energy transmitted through the coated layer is absorbed in the substrate and changed into heating energy to heat the substrate surface. Solvents in the coated layer are evaporated due to the heat passing from the heated substrate surface to the back surface of the coated layer. The energy absorbed by the coated layer accelerates the hardening of the coated layer. A combination of these two types of infrared radiation prevents 1) the coated layer from being heated irregularly and 2) the generation of pin holes in the heated layer, and also shortens the drying period.

16 Claims, 13 Drawing Sheets

DRYING METHOD AND DEVICE FOR COATED LAYER

BACKGROUD OF THE INVENTION

1. Field of the Invention

The present invention generally relates to a drying method for various coating materials coated on a substrate such as a metal plate and a drying device therefor. Particularly, the present invention relates to a drying method and a drying device for various coating materials such as thermosetting resins, of which the methods and device utilize infrared radiation. More particularly, the present invention relates to a drying method and a drying device for various coating materials, of which the method and device can solifidy the coating material after evaporation of the solvent from the coating material.

2. Description of Prior Art

Conventionally, various drying methods employing a hot air furnace, a far infrared radiation furnace and the like have been well known and commonly used to dry a coated material on a substrate such as a metal plate and the like. The substrate provided with the coated material to be dried is referred to as a work and the substrate per se is referred to as a mother material in this specification. The drying process and function of these drying methods have been understood as follows.

First, a work whose mother material is coated with a paint mainly composed of resin such as an acrylic resin is set in a furnace. The work is subjected to a blow of hot air or far infrared radiation. The solvent of the coated material is firstly evaporated from the work surface and the surface is gradually solidified after losing flowability from the surface layer. Furthermore, the solidification of the coated layer is accelerated by heating when the heat from the hot air is transmitted to the inside of the work; i.e., the mother material. On this occasion, the solvent existing on the inside of the surface of the heated material is gasified and the solvent gas pierces through the solidified surface layer in order to evaporate from the work surface. Thus many fine pores and pin holes are generated in the work surface. In order to prevent the work surface from generating the pores and pin holes, conventional furnaces must be controlled to slowly increase the heating temperature after the solvent is evaporated from the work in a setting room.

The conventional drying methods which employs such a process require a relatively long period to complete the drying operation because the drying temperature must be kept at a low level in order to avoid generating the pores and pin holes. This is a serious problem to overcome. Particularly, in a specific type furnace employing a combination of infrared radiation and a blow of hot air for the purpose of quick drying, the surface temperature of the work tends to be remarkably higher then the area below this surface which causes the difference of temperature between the surface of the coated layer and the interface between the coated layer and the metal substrate. This temperature difference accelerates the generation of pores and pin holes in the coated layer.

In addition to the above conventional methods, various drying methods are disclosed in Japanese Patent Application for Utility Model, Laid-Open Publication No.1-151873, entitled "Near Infrared Radiation Stove for Liquid and/or Powder Coatings"; Japanese Patent Application for Utility Model, Laid-Open Publication No.2-43217, entitled "Light Panels for Exclusive Use in Furnace for Baking Coating Material"; and U.S. Pat. No. 4,863,375 entitled "Baking Method for Use with Liquid or Powder Varnishing Furnace". One of these documents relates to a baking method in a near infrared radiation stove for liquid and/or powder coatings. This method utilizes the properties of near infrared radiation such as quick heating at a high temperature with a remarkable penetration to improve the baking method in the stove so that the coated substance can be quickly dried and its adhesion can be also increased. In detail, liquid type or powder in liquid type coating material is applied to the surface of the substrate and then subjected to a melt-heating work to realize a uniform coating layer on the substrate surface. Another document relates to a drying furnace employing a near infrared radiation whose light source is provided at the back with a ceramic reflector containing a heater and a drying method which uses a drying furnace in which a high temperature section and a low temperature section are sequentially formed.

On the other hand, "medium wave infrared radiator" is disclosed in "Coating Technique" special October number, pp 211 to 213, issued on 1990, Oct. 20, published by K. K. Rikoh Shuppan (Science and Technology Publishing Company Inc.). This document details that radiated energy improving a coated layer is partially absorbed by the coated layer, reflected by the layer and transmitted through the layer, respectively. The absorbed energy changes to heat energy which causes the coated layer to dry. Furthermore, the transmitted energy causes the substrate or the mother material of the coated layer to heat so that the coated layer is heated from the inside.

Generally, physical properties of infrared radiation are known as follows.

(1) Near infrared radiation: temperature is 2000° to 2200° C., the maximum energy peak of the wave length is generated at about 1.5 μm, energy density is high, reflected and transmitted energy are greater, rising speed is fast (1 to 2 sec), life time is short (about 5000 hours).

(2) Medium infrared radiation: temperature is 850° to 900° C., the maximum energy peak of the wave length is generated at about 2.5 μm, energy density is medium, absorbed energy and transmitted energy are balanced so that energy can be permeated into the inside of the coated layer, life time is long.

(3) Far infrared radiation: temperature is 500° to 600° C., the maximum energy peak of the wave length is generated at about 3.5 μm, energy density is low, energy is remarkably absorbed by the surface of the coated layer so that the surface tends to be heated, rising speed is slow (5 to 15 min), circulation loss is great.

In order to obtain a superior coating quality by using the medium wave length infrared radiation with its maximum efficiency, the following two conditions are satisfied on the same occasion.

1. Radiated energy from an infrared radiator varies as the fourth power raised value of the absolute temperature (T) of the radiator $Eb \propto T^4$. In other words, the radiated energy is increased as the temperature of the radiator rises.

2. The maximum energy peak of the wave length is positioned a little to short wave length with respect to the peak absorptivity of the coated layer.

The maximum energy peak of the wave length of infrared radiation used in an industrial scene for heating such coated layers is concentrated at about 3 μm without exception. Therefore, the infrared radiator having the maximum energy peak of wave length at about 2.5 μm is preferable for use in effectively drying the coated layer by a combination of the absorbed energy and the transmitted energy which can effectively and uniformly heat the coated layer from its surface and backsurface.

The relation between the temperature (T) of the infrared radiator and its maximum energy peak of wave length generated at λm is represented by Wien's displacement law: $\lambda m = 2897/T$ When the maximum energy peak of wave length is generated at λm 2.5, the above equation is rewritten as follows:

$$T = 2897/2.5 = (t + 273)$$

$$t = 880^\circ \text{ C.}$$

Consequently, the maximum efficiency can be realized when the medium wave length infrared radiation is used in satisfying the above condition.

The above described conventional documents Japanese Patent Application for Utility Model, Laid-Open Publications No. 1-151873 and 2-43217, and U.S. Pat. No. 4,863,375, however do not detail any optimum conditions of the infrared radiation applied to the coated layer on a metal substrate. These conventional documents disclose the use of near infrared radiation to dry coated layers and give a general explanation on the properties of the near infrared radiation to be used.

In the use of far and medium infrared radiation for drying coated layers, their wave range is selected so that the irradiated infrared energy is highly absorbed by the coated layer. This is for the purpose of heating from the layer surface. However, this will cause the generation of many pin holes or pores in the layer surface, and thus the period for drying the coated layer will be prolonged whilst keeping the drying temperature at a low level to prevent the coated layer from generating pin holes or pores.

"Coating Technique Special October Number" does not detail any optimum conditions of infrared radiation according to studies on the absorptivity of the infrared radiation to the mother material and/or the cause of pin holes or pores generated in the coated layer. But this document reaches the conclusion that the infrared radiator which provides the maximum energy peak of wave length at about 2.5 μm is preferable because its radiated energy can be effectively absorbed and transmitted to heat the surface and backsurface of the coated layer.

The inventor of this application found that the coated layer can be prevented from generating pin holes or pores by using the near infrared radiation whose wave range can easily transmit through the coated layer rather than the range having a high absorptivity to the coated layer. It can be supposed that the infrared radiation transmitted through the coated layer directly heats the substrate surface not the layer surface and the coated layer is gradually dried from its backsurface by the heat.

In the case of using the metal substrate, its reflectivity against infrared radiation is increased as the wave length of the infrared radiation is prolonged and its absorptivity for thermal energy is increased as the wave length becomes shorter. As a result, when near infrared radiation is used for drying coated layers, it can be supposed that the near infrared radiation having a high transmissivity to the coated layer; that is, a poor absorptivity to the coated layer is preferably used to prevent the coated layer from generating pin holes.

In the case of using infrared radiation having a high transmissivity relative to the coated layer and a high absorptivity relative to the substrate for drying the coated layers, some layers generate fine bubbles in the whole surface or a thicker layer portion when metal plates whose thickness is relatively thin are used for the substrate. These fine bubbles are generated in such a manner that the solvent contained in the coating material formed on the substrate is suddenly boiled during the solidification step of the coated layer.

FIG. 17 shows experimental data representing the relation between the layer thickness and the generation of fine bubbles when the epoxy resin layer is coated on a thin Bonderized steel plate of 1.6 mm thickness. According to this experimental test, the fine bubbles are easily generated as the layer becomes thicker.

On the other hand, when the substrate is relatively thick or far infrared radiation is used for drying the layer, the fine bubbles are not generated.

In addition to the above described phenomena, the coated layer includes various solvents having different boiling points.

The inventor of this application has found the following facts from the above described phenomena.

In the case of using the infrared radiation in a specific range which has a high transmissivity to the coated layer formed on the substrate and a high absorptivity to the substrate, the substrate is heated prior to the layer surface in comparison with the case of using the far infrared radiation. While the heating energy is used to heat the thick substrate and a relatively long period is required to dry the coated layer, the heating energy can quickly heat the coated layer formed on the thin substrate. The solidification of the coated layer owing to bridge formation reaction and the like is accelerated by the heat transmitted from the substrate generated by the infrared radiation. On the contrary, since the far infrared radiation does not contain as much energy as the above described infrared radiation, the coated layer is gradually heated and thus the drying period requires longer but the fine bubbles are not generated. This effect is caused by the solvents contained in the layer which are gradually evaporated in order of boiling point.

BRIEF SUMMARY OF THE INVENTION

It is an object of the present invention to provide a drying method and device for various coating materials such as thermosetting resins coated on a substrate such as a metal plate of which the method and device can dry the coated layers without generation of pin holes or fine bubbles.

To accomplish the above described objectives, a drying method according to the present invention comprises a coating step for coating a coating material on a substrate, a first radiating step for applying a first infrared radiation whose wave length is easily absorbed by the substrate with less absorption to the coated layer, and a second radiating step for applying a second infrared radiation whose wave length is easily absorbed by the coated layer.

In the drying method according to the present invention, the infrared radiation radiated at the first step is transmitted through the coated layer and absorbed by the substrate and thus the substrate surface is heated by the absorbed energy. Solvents in the coating material are evaporated from the coated layer by the heat at the substrate surface. The infrared radiation radiated at the second step is absorbed by the coated layer to solidify reactants in the coating material.

The present invention further provides a drying device comprising a first infrared radiator for applying a first infrared radiation whose wave lenth is easily absorbed by the substrate with less absorption to the coated layer, and a second infrared radiator for applying a second infrared radiation whose wave length is easily absorbed by the coated layer.

The first infrared radiator includes a plurality of IR lamps arranged apart from each other, and the second infrared radiator includes a plurality of IR lamps arranged closely. According to these arrangements, the coated layer is gradually heated and dried without the generation of pin holes and fine bubbles.

Preferably, the IR lamps of the first and second infrared radiators are mounted on a plurality of bank shape members inclined with respect to the work surface. While the work is passing in front of the inclined infrared radiators, a constant amount of infrared energy is slowly applied to the work.

Other and further objectives, features and advantages of the invention will appear more fully from the following description taken in connection with the accompanying drawings.

DETAILED DESCRIPTION OF THE PREFERRED EMBODIMENT

Figure 1:
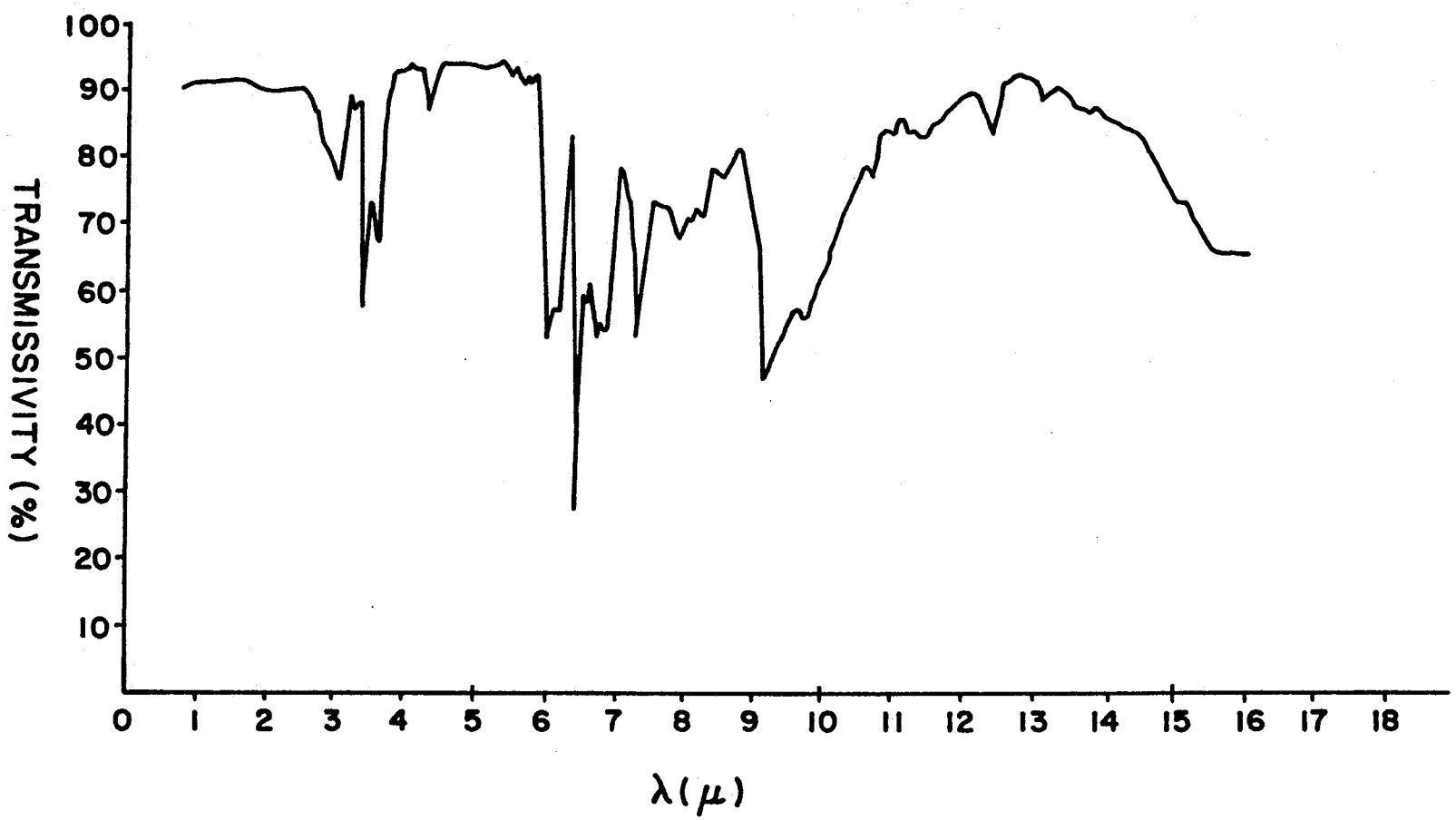
FIG. 1 is a characteristic curve showing an infrared spectrum of butyl urea - butyl melamine resin.

Referring to the drawings, a work 100 to be dried by a drying method and device according to the present invention includes a metal substrate and a coating material coated thereon.

The metal substrate is preferably selected from iron, aluminium, copper, brass, gold, beryllium, molybdenum, nickle, lead, rhodium, silver, tantalum, antimony, cadium, chromium, iridium, cobalt, magnesium, tungsten, and so on. More preferably, copper, aluminium and iron are used.

The coating material is preferably selected from acrylic resin paint, urethane resin paint, epoxy resin paint, melamine resin paint and so on. The coating material is coated on the metal substrate by any conventional manner such as spray coating, roller coating, and so on. Furthermore, the coated layer may be formed by a melt-deposition of powder coating material (polyester group, epoxy group, acrylic group and so on).

Tables 1 to 4 show reflectance of metals for various wave lengths, from the American Institute of Physics Handbook 6-120. Generally, absorptivity is inversely proportional to reflectance.

Figure 2:
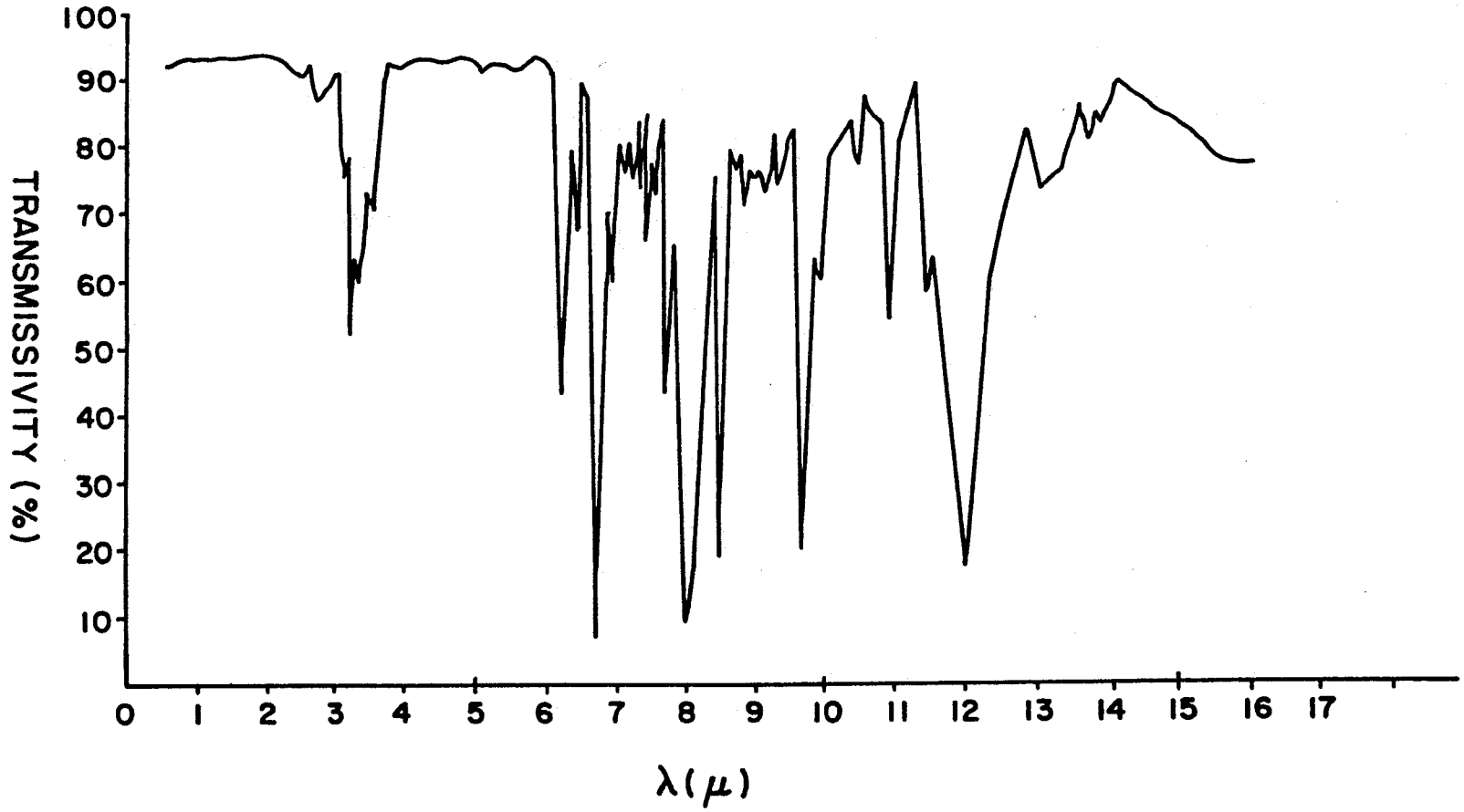
FIG. 2 is a characteristic curve showing an infrared spectrum of bisphenol A type epoxy resin.
Figure 3:
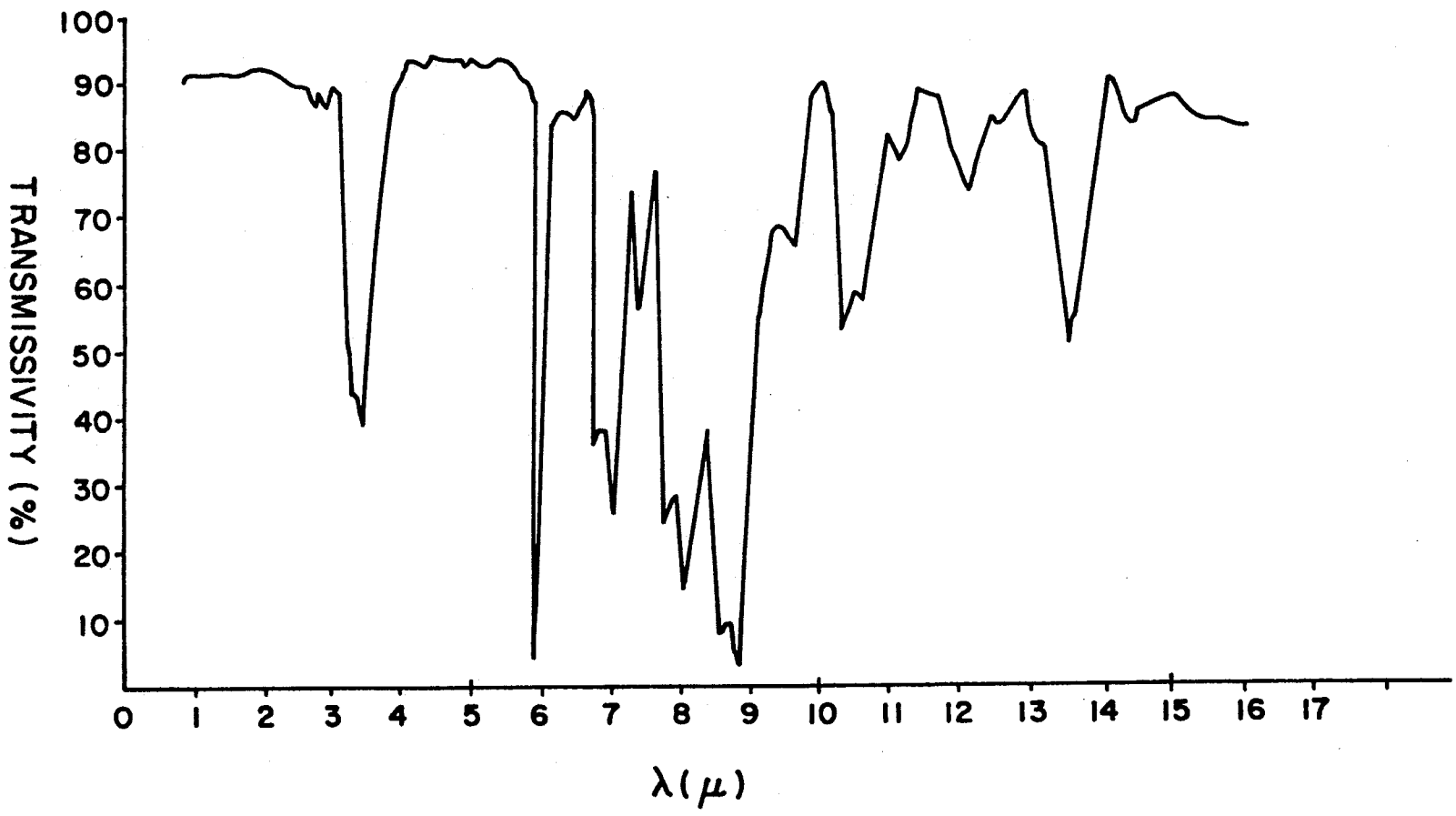
FIG. 3 is a characteristic curve showing an infrared spectrum of MMA homopolymer (acrylic group)
Figure 4:
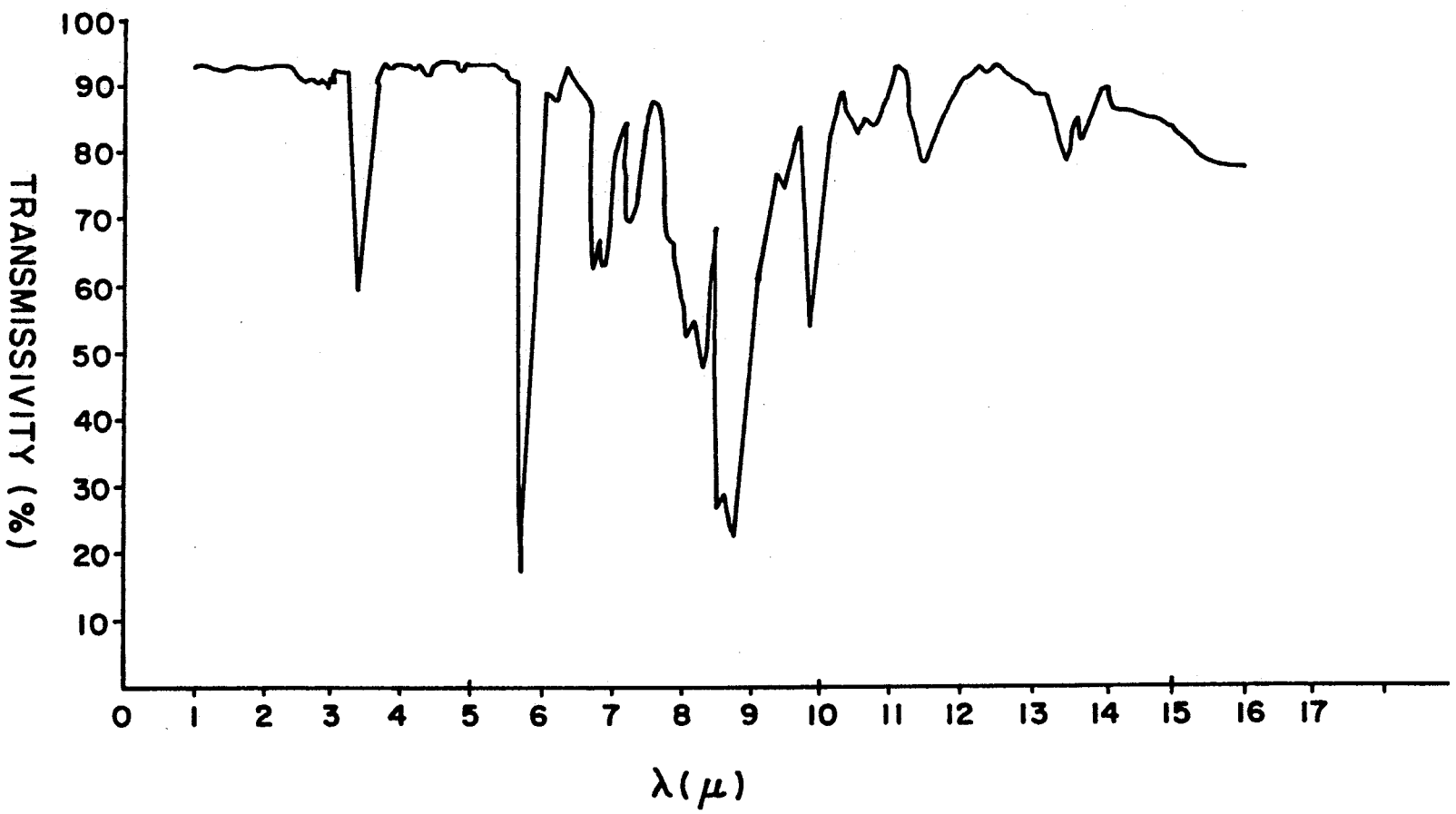
FIG. 4 is a characteristic curve showing an infrared spectrum of EMA homopolymer (acrylic group)
Figure 5:
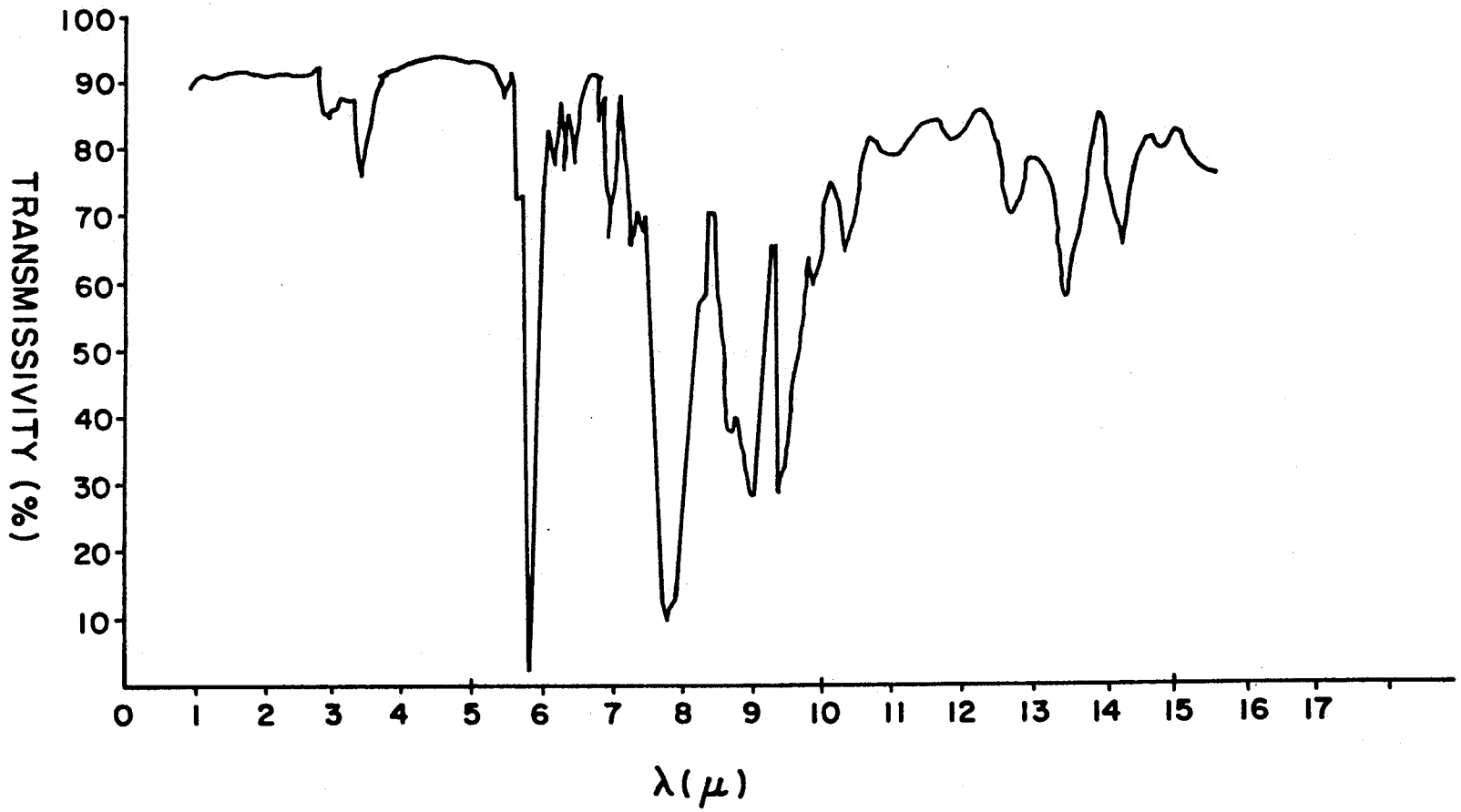
FIG. 5 is a characteristic curve showing an infrared spectrum of unsaturated polyester resin.
Figure 6:
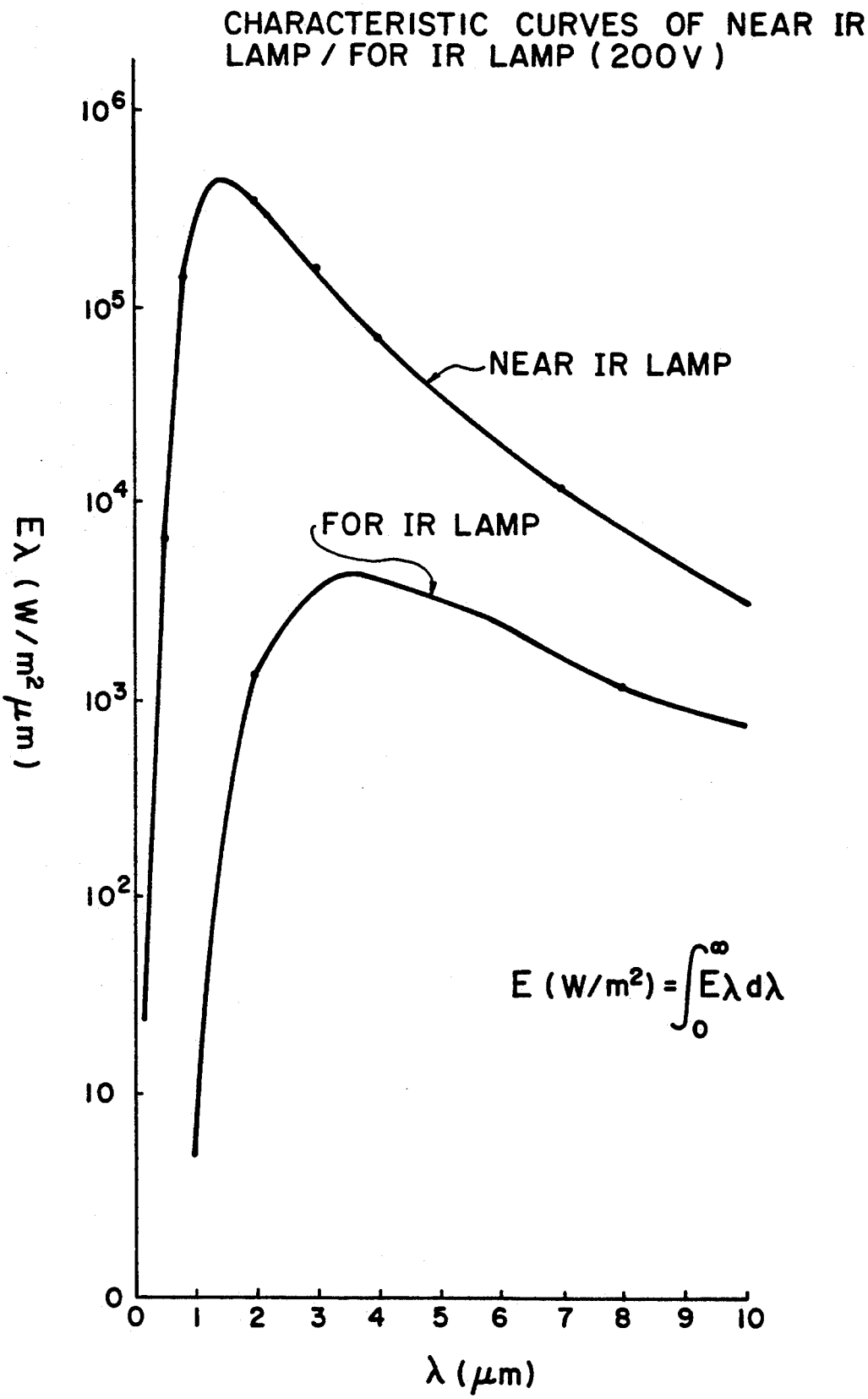
FIG. 6 is a graph showing characteristic curves of two different lamps for near infrared radiation and far infrared radiation.

FIG. 1 shows an infrared spectrum curve of butyl urea - butyl melamine resin. FIG. 2 shows an infrared spectrum curve of bisphenol A type epoxy resin. FIG. 3 shows an infrared spectrum curve of MMA homopolymer (acrylic group). FIG. 4 shows an infrared spectrum curve of EMA homopolymer (acrylic group). FIG. 5 shows an infrared spectrum curve of unsaturated polyester resin. FIG. 6 shows two characteristic curves of two different lamps for near infrared radiation used in this embodiment and far infrared radiation used in comparative tests. The near infrared lamp has a peak at 1.4 $\mu$m and the far infrared lamp has a peak at 3.5 $\mu$m.

In a case that the work 100 is composed of one of the metals as described above and one of the coating materials as described above, the infrared lamp having a peak at 2 $\mu$m or less is preferably used, more preferably than the near infrared lamp having a peak at 1.2 $\mu$m to 1.5 $\mu$m.

Hereinafter, the first and second preferred embodiments of the drying method according to the present invention will be described in detail referring to comparative examples 1 and 2.

FIRST EMBODIMENT OF THE INVENTION

Light Source: near infrared lamp having a peak at 1.4 μm.

Substrate: Bonderized steel plate (thickness 1 mm, dimension 100 mm×100 mm)

Coating material: melamine resin (Amilack No. 1531 manufactured by Kansai Paint Inc., White, Alkyd-melamine resin paint, viscosity 20 sec by Iwatacup NK-2 viscometer)

COMPARATIVE EXAMPLE 1

Light Source: far infrared lamp having a peak at 3.5 μm.

Substrate: Bonderized steel plate (thickness 1 mm, dimension 100 mm×100 mm)

Coating material: melamine resin (Amilack No. 1531 manufactured by Kansai Paint Inc., White, alkyd-melamine resin paint, viscosity 20 sec by Iwatacup NK-2 viscometer)

SECOND EMBODIMENT OF THE INVENTION

Light Source: near infrared lamp having a peak at 1.4 μm.

Substrate: Bonderized steel plate (thickness 1 mm, dimension 100 mm×100 mm)

Coating material: acrylic resin (Magicron No. 1531 manufactured by Kansai Paint Inc., White, acrylic-melamine epoxy resin paint, viscosity 20 sec by Iwatacup NK-2 viscometer)

COMPARATIVE EXAMPLE 2

Light source: far infrared lamp having a peak at 3.5 μm.

Substrate: Bonderized steel plate (thickness 1 mm, dimension 100 mm×100 mm)

Coating material: acrylic resin (Magicron No. 1531 manufactured by Kansai Paint Inc., White, acrylic-melamine-epoxy resin paint, viscosity 20 sec by Iwatacup NK-2 viscometer)

Under the conditions described in Embodiment 1, Comparative Example 1, Embodiment 2, and Comparative Example 2, samples having three different coated layers whose thicknesses are 30 μm, 40 μm, and 50 μm were respectively subjected to six drying operations under the following drying temperatures and radiating periods; 130° C.×12 min, 140° C.×10 min, 150° C.×8 min, 160° C.×6 min, 170° C.×5 min, and 180° C.×4 min. The resulted samples were observed to count the pin holes generated in their surface. The counted number of pin holes and bubbles are showin in Tables 5 to 8.

Embodiment 1 corresponds to Table 5, Comparative Example 1 corresponds to Table 6, Embodiment 2 corresponds to Table 7 and Comparative Example 2 corresponds to Table 8.

Figure 8:
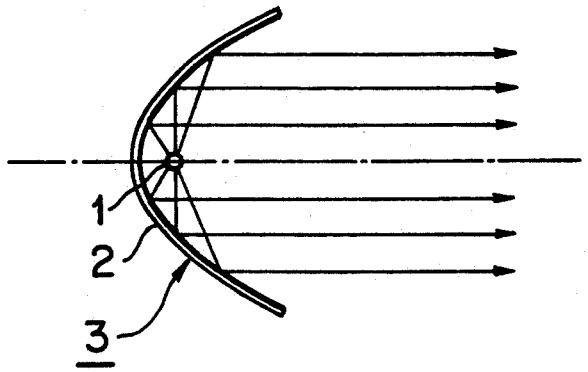
FIG. 8 is a partially enlarged section showing an infrared radiator with a parabolic reflector used in the drying device of the present invention.
Figure 9:
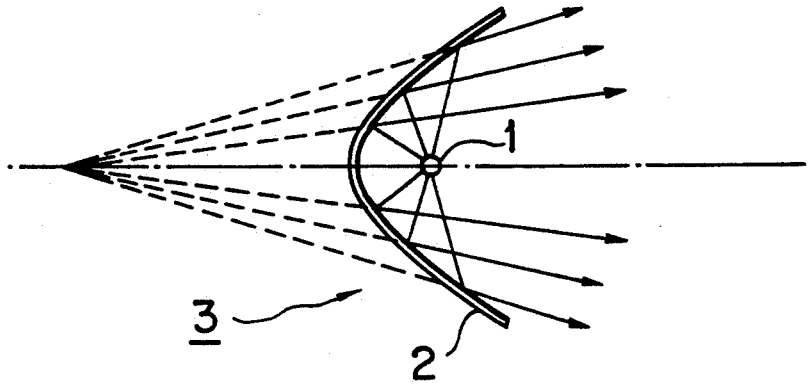
FIG. 9 is a partially enlarged section showing another infrared radiator with a phyperbolic reflector used in the drying device of the present invention.
Figure 10:
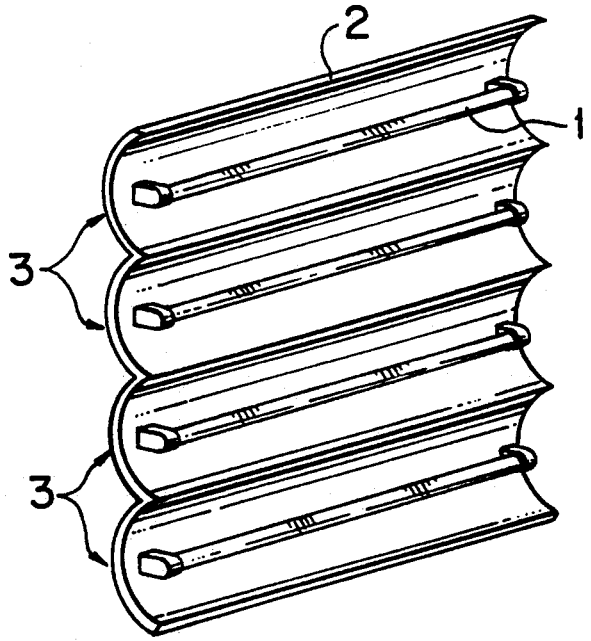
FIG. 10 is a perspective view showing an assembly of plural infrared radiators used in the drying device of the present invention.

In the above described embodiments and comparative examples, at least one infrared radiator 3 was used, each of which includes at least one infrared (IR) lamp 1 and a reflector 2 behind the lamp 1. As shown in FIG. 8 and FIG. 9, the IR lamp 1 is set at the focus of the reflector 2. The reflector 2 shown in FIG. 8 is configured in a parabolic section from which a light beam is reflected parallel to each other. The reflector 2 shown in FIG. 9 is configured in a hyperbolic section from which a light beam is reflected radially. FIG. 10 shows an example of assembled plural infrared radiators 3 vertically.

Comparative tests using the IR lamps with and without the reflector 2 for heating the work 100 up to 120° C. were carried out. The case without the reflector 2 required 7 min, while with the reflector 2 only 1 min 20 sec were required. The maximum temperature of the work 100 heated by the lamp with the reflector 2 was 1.65 times as large as the case without the reflector 2. The IR lamp with the reflector can concentrate the radiated beam onto the work so that the heating period can be shortened.

Figure 11:
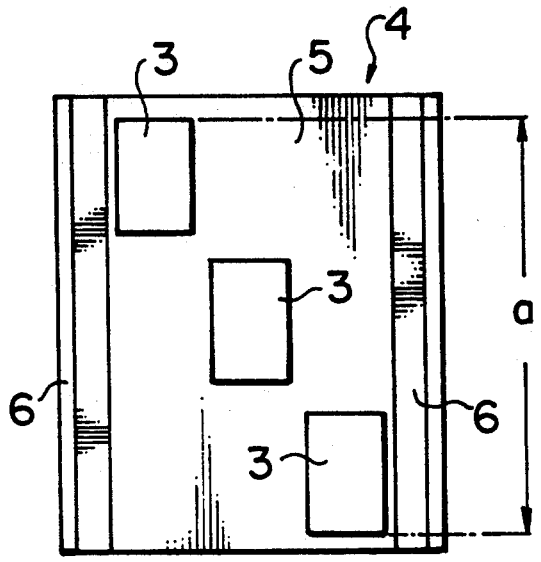
FIG. 11 is an elevational view showing one example of arrangement of infrared radiators mounted on a bank shape member assembled in the drying device of the present invention.
Figure 12:
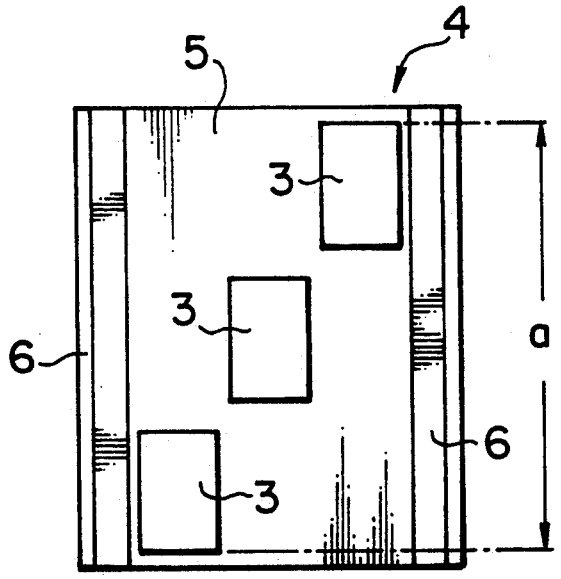
FIG. 12 is an elevational view showing another example of arrangement of infrared radiators mounted on a bank shape member assembled in the drying device of the present invention.
Figure 13:
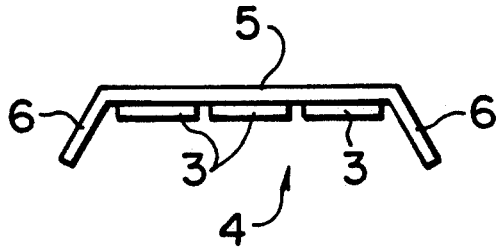
FIG. 13 is a plan view showing the infrared radiators mounted on the bank shape member shown in FIG. 11 and FIG. 12.

FIG. 11 to FIG. 13 show the infrared radiators mounted on a bank shape member 4. FIG. 11 and FIG. 12 are elevational views showing different configurations and FIG. 13 is a plan view showing the above two configurations.

The bank shape member 4 includes a center wall 5 on which the IR radiators 3 are mounted and side mirror walls 6, 6 bent inwardly to act as a reflector. As shown in FIG. 11, FIG. 12 and FIG. 13, the IR radiators 3 are arranged in vertically inclined direction. The inclined arrangement of the radiators 3 is not only limited to the configuration shown in FIG. 11 where the first radiator is set at the lower position near the right side mirror wall 6 but also to the configuration shown in FIG. 12 where the first radiator is set at the upper position near the right side mirror wall 6.

The IR radiators 3 are mounted on the inner wall of a furnace through the bank shape member 4 or directly mounted thereon.

The first and third radiators define vertically radiating area "a" as shown in FIG. 11 and FIG. 12 which is no longer than the vertical length of the work 100. However, the vertically radiating area "a" may be shorter than the work 100 when it is in a plate shape.

A comparative experiment using two types of furnaces; i.e., a first drying furnace in which three IR lamps are inclinedly arranged or a second drying furnace in which three IR lamps are aligned was carried out to distinguish these two type furnaces. Samples of the work 100 (substrate: bonderized steel plate having a thickness of 1.2 mm, dimension of 100 mm×100 mm, coating materials: Magicron white manufactured by Kansai Paint Inc., viscosity of 18 sec by Iwatacup NK-2) having different layer thicknesses were subjected to the infrared radiation for 4 min in these two type furnaces. In the case of the second furnace, the sample having a layer thickness of 40 μm did not generate any bubbles, while the sample having a layer thickness of 51 μm generated a few bubbles and of 54 μm generated a lot of bubbles. On the other hand, in the case of the first furnace, the sample having a layer thickness at least 57 μm, generated bubbles.

Figure 7:
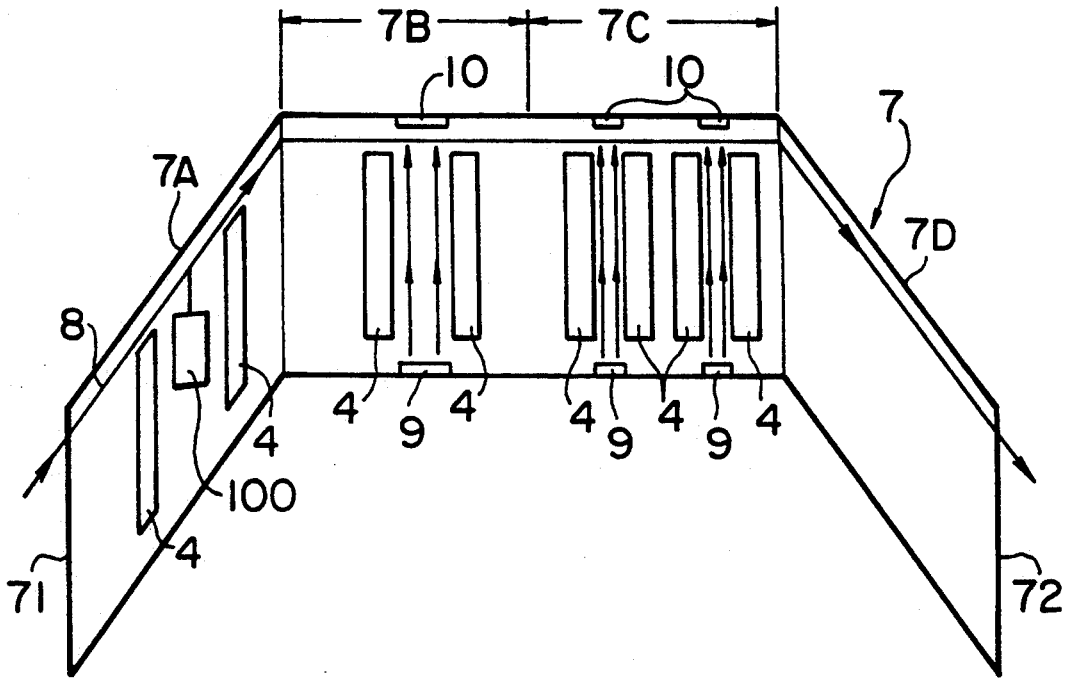
FIG. 7 is a longitudinal section showing a drying apparatus according to one embodiment "A" (tunnel shape furnace or camel back oven) of the invention.

FIG. 7 is a longitudinal section showing a drying apparatus in a camel back furnace 7 according to an embodiment "A" of the present invention.

The furnace 7 includes an inlet opening 71 and an outlet opening 72 to take the work 100 in and out of the furnace 7, and four sections 7A, 7B, 7C and 7D. The elevation section 7A, and the plane sections 7B and 7C are provided with the IR lamps 1 or the IR radiator mounted bank members 4, respectively.

In this embodiment, for the IR lamps 1 set on the elevation section 7A and the plane section 7B near infrared lamps having a peak of wave length at 2 μm or less, preferably 1.2 to 1.5 μm are used. Since the optimum IR lamps depend on the kind of substrate and coating material to be used, the infrared radiation having a high transmissivity to the coating material coated on the substrate and a high absorptivity to the substrate is practically selected with reference to FIG. 1 to FIG. 6 and Table 1 to Table 8.

The IR lamps 1 set at the plane section 7C have a high absorptivity relative to the coated layer. For example, in the case of melamine resins or acrylic resins which are hardened by condensation reaction, an intermediate IR lamp having a peak at about 2.8 μm is preferably used. In the case of urethane resins which are hardened by urethane reaction, an IR lamp having a peak at about 5.6 μm is preferably used. In the case of silicone resins which are hardened by Si-reaction, an IR lamp having a peak at about 7 to 8 μm is preferably used. The furnace per se can employ IR lamps having peak at the range of 1.3 to 20 μm.

The work 100 is transported in and out of the furnace 7 by a conveyor 8.

The IR lamps 1 or the IR radiators 3 at the plane section 7B are intimately arranged rather than arranged like the elevation section 7A. The plane section 7C employs a more intimate arrangement than the section 7B.

In a conventional drying furnace, the IR lamps 1 are equally arranged at intervals of 100 to 150 mm. While in this embodiment "A", the intervals of the IR lamps 1 on the sections are varied such that the section 7A provides intervals of 300 to 400 mm, the section 7B provides intervals of 200 to 300 mm, and the section 7C provides intervals of 100 to 150 mm. This arrangement ensures that the work 100 is gradually applied with heating energy to heat the coated layer by a slow degree.

For example, experimental samples using Bonderized steel plate having a thickness of 1.0 mm as a substrate and melamine resin as coating material which is coated on the substrate to form various thickness layers such as 12 to 14 m, 15 to 20 μm, 20 to 24 μm, 24 to 29 μm, 31 to 38 μm and 45 to 50 μm were heated in the camel back furnace 7 as shown in the embodiment "A". Even the layers thicker than 35 μm generated no popping and bubbles.

The furnace 7 further includes a plurality of air inlet slits 9 through which hot air is blown, and a plurality of air outlet slits 10 through which hot air is exhausted. The air inlet slits 9 and the air outlet slits 10 are oppositely formed in the plane sections 7B and 7C near the bottom and near the ceiling, respectively so that hot air is blown from the slits 9 into the furnace 7 and drawn into the slits 10. The temperature of the hot air is adjusted to 160° C. or less for the plane section 7B and to 180° C. or less for the plane section 7C. In this furnace 7, the infrared radiators 3 or the combination of the radiators 3 and the hot air are so controlled as to provide the air temperature near the section 7A being in the range of 60° to 70° C., near the section 7B being in the range of 120° to 160° C., and near the section 7C being in the range of 160° to 180° C.

The heating period at the sections 7A, 7B and 7C depend on the thickness of the substrate. In detail, at the section 7A, the Bonderized steel substrates having a thickness of 0.8 mm, 1 mm, and 3.2 mm require 1 min, 1 min 30 sec and 2 min 30 sec, respectively. At the section 7B, the Bonderized steel substrates having a thickness of 0.8 mm, 1 mm, and 3.2 mm require 1 min, 1 min 30 sec and 2 min 30 sec, respectively. At the section 7C, the Bonderized steel substrates having a thickness of 0.8 mm, 1 mm, and 3.2 mm require 1 min 30 sec, 2 min and 4 min, respectively.

Tables 9 to 16 show the boiling points of the solvents included in various thinners used for the coating materials.

Here, a typical operation of the embodiment "A" is described in detail.

The work 100 is transported into the camel back type furnace 7. Firstly, at the elevation section 7A, the coated layer of the work 100 is subjected to infrared radiation having the high transmissivity to the coated layer and the high absorptivity to the substrate, and simultaneously applied with the hot air adjusted at 60° to 70° C. for about 1 min to 2 mins 30 sec. The infrared radiation heats the substrate and the back surface of the coated layer adjacent to the substrate, so that the solvents in the coating material are evaporated. Furthermore, some solvents having a relatively low boiling point, as shown in Tables 9 to 16, such as ethyl acetate and methyl ethyl ketone, are effectively evaporated by the hot air without boiling.

Succeedingly, at the plane section 7B, the coated layer of the work 100 is also subjected to the infrared radiation having the same performance as the section 7A and the hot air is adjusted to between 120° to 160° C. for about 1 min 30 sec to 2 min 30 sec. A few components not evaporated at section 7A and some specific solvents having a medium boiling point as shown in the Tables 9 to 16 such as toluene, xylene, butyl acetate, n-butanol, and so on, are effectively evaporated without boiling. On the same occasion, levelling and curing for the coated layer begins.

At the plane section 7C, the coated layer of the work 100 is subjected to infrared radiation having the high absorptivity to the coated layer and simultaneously applied with the hot air adjusted at between 20° to 160° C. for about 3 min 30 sec. A few components not evaporated at the section 7B and some specific solvents having a high boiling point, as shown in the Tables 9 to 16, are effectively evaporated by the hot air without boiling and the infrared energy is absorbed by the reaction elements in the coating material of which the elements accelerate the bridge reaction and condensation reaction. Thus, the coated material is completely cured.

While the work 100 is transported from the elevation section 7A, the plane sections 7B and 7C of the camel back furnace 7 by the conveyor 8, the coated layer is firstly heated from its back surface near the substrate and the various solvents having different boiling points are gradually evaporated by the combination of hot air and the near infrared radiation. Finally, the coated layer is hardened by the condensation reaction of the coating material applied with the medium infrared radiation. Accordingly, this process can prevent the coated layer from generating any pin holes and bubbles. In addition to this advantage, the drying period can be shortened.

Figure 14:
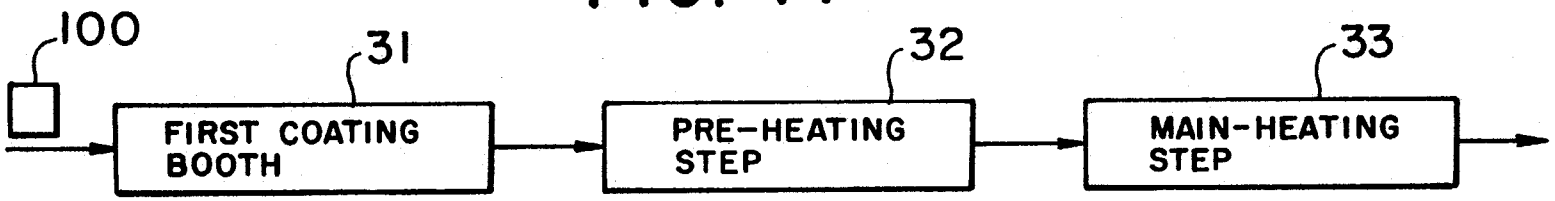
FIG. 14, FIG. 15 and FIG. 16 are flow charts showing various drying processes according to embodiments B1, B2 and B3 of the present invention.
Figure 15:
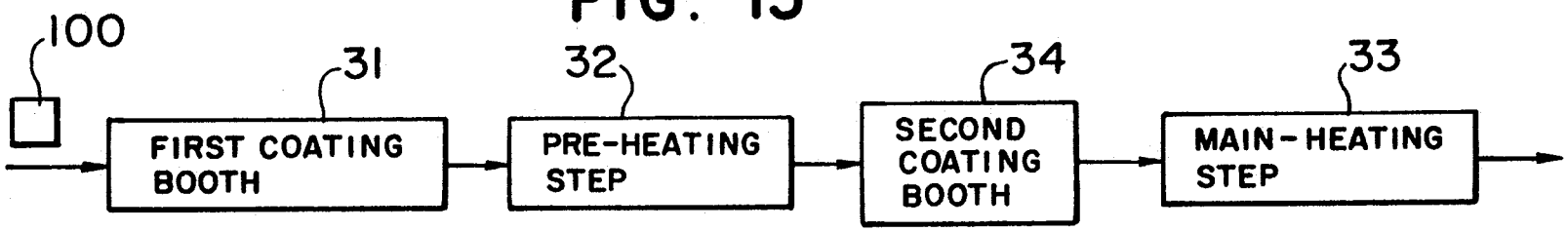
Figure 16:
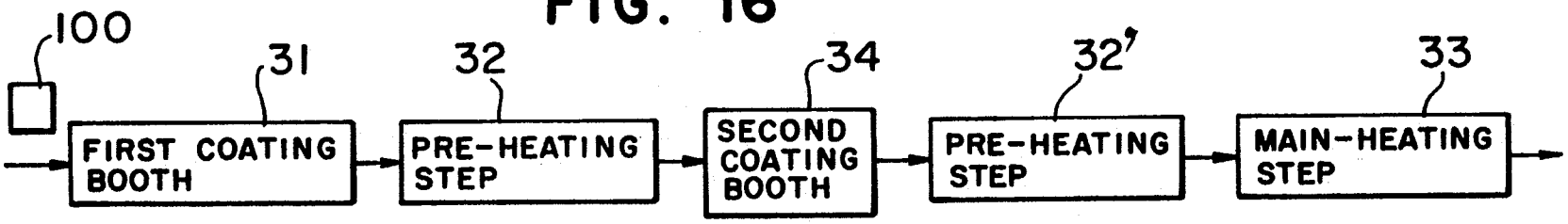

Referring to FIG. 14, FIG. 15 and FIG. 16, there are shown further embodiments B1, B2 and B3 according to the present invention.

In these embodiments, the work 100 is subjected to a pre-heating step and a main heating step after the coating step. The pre-heating step employs a plurality of heating units generating infrared radiation having a high transmissivity to the coated layer and a high absorptivity to the substrate. The optimum infrared radiation is selected with reference to FIG. 1 to FIG. 6 and Table 1 to Table 8. The main heating step employs a plurality of heating units generating far infrared radiation or blowing hot air.

In the drawings, the reference numerals 31 and 34 denote a first coating booth and a second coating booth, respectively. They are constructed in the same or similar structure such as an automatic controlled coating device by which a substrate, for example Bonderized steel plate, is provided with a layer of coating material selected from the aforementioned materials.

In FIG. 15 and FIG. 16, the second coating booth 34 shown in the embodiments B2 and B3 provides an additional coating layer, for example a thickness of 30 μm, on the work 100 which is already heated by the pre-heating step 32 to form a thick coated layer on the substrate.

The pre-heating step 32 employs a tunnel shape furnace or a camel back furnace including IR lamps 1 generating infrared radiation having a peak of wave length at 2 μm or less, preferably 1.2 to 1.5 μm (near infrared radiation). Alternatively, the pre-heating step 32 may employ the furnaces shown in FIG. 17 and FIG. 18.

The furnace at the pre-heating step 32 is adjusted to keep its inner air temperature at 140° to 160° C. in the embodiment B1. The work 100 is applied with heat for 3 to 4 min to make the surface temperature of the work 100 at 40° to 60° C. In the embodiments B2 and B3, the work 100 is applied with heat for 2 to 3 min to make the work 100 at 50° to 70° C.

The main heating step 33 employs a tunnel shape furnace, a camel back furnace or a hot air furnace. The furnace at the main heating step 33 is adjusted to keep its inner air temperature at 130° to 150° C. in the embodiment B1 and the work 100 is applied with heat for 20 to 30 min. In the embodiments B2 and B3, the furnace is adjusted to keep its inner air temperature at 200° to 220° C. and the work 100 is applied with heat for 30 to 50 min.

In the embodiment B1 shown in FIG. 14, the substrate is provided with a layer of coating material by the first coating booth 31, and succeedingly the coated layer on the substrate is applied with the infrared radiation having a high transmissivity to the coated layer and a high absorptivity to the substrate in the furnace at the pre-heating step. The infrared radiation transmitted through the coated layer is absorbed by the substrate and changed to heating energy to heat the back surface of the coated layer. Thus the solvents in the coated layer are evaporated before the layer surface is completely hardened. Then the work 100 is further applied with heat by the far infrared radiation and hot air in the furnace of the main heating step 33. Such heating energy is absorbed by the coated layer to make the layer surface harden. Since the solvents were already evaporated from the coated layer at the pre-heating step, the layer surface can be quickly hardened without the generation of pin holes and bubbles.

In the embodiment B2 shown in FIG. 15, the work 100 is further provided with an addtional layer at the second coating booth 34 after the pre-heating step 32. Then the work 100 is subjected to the main heating work at the main heating step 33. Since the substrate keeps heating energy fed from the infrared radiation at the pre-heating step during the second coating step, the solvents included in the additional layer can be evaporated owing to the heating energy. Thus the additional layer can be completely coated on the precedingly coated layer without sagging.

In the embodiment B3 shown in FIG. 16, the work 100 is subjected to the pre-heating at a second pre-heating step 32' again after the first pre-heating step 32 and the second coating step 34. Then the work 100 is subjected to the main heating work at the main heating step 33. The second pre-heating ensures the evaporation of the solvents included in the additional layer so that the additional layer can be completely coated on the preceedingly coated layer without sagging. Since the evaporation is accelerated by this second pre-heating, the heating temperature at the main heating step 33 can be increased to shorten the drying period.

Figure 17:
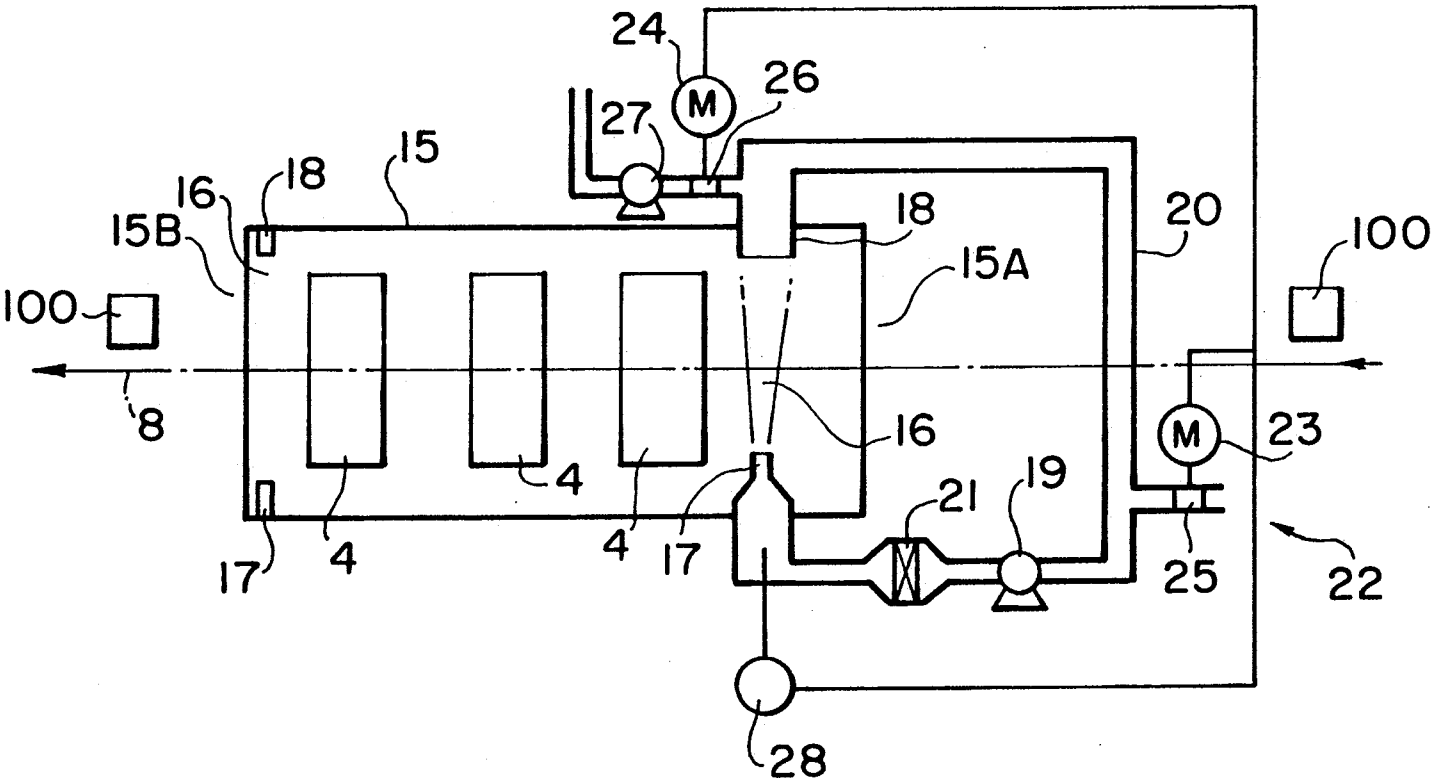
FIG. 17 is a schematically sectional view showing one example of a pre-heating furnace or a main heating furnace used in the embodiments B1, B2 and B3.
Figure 18:
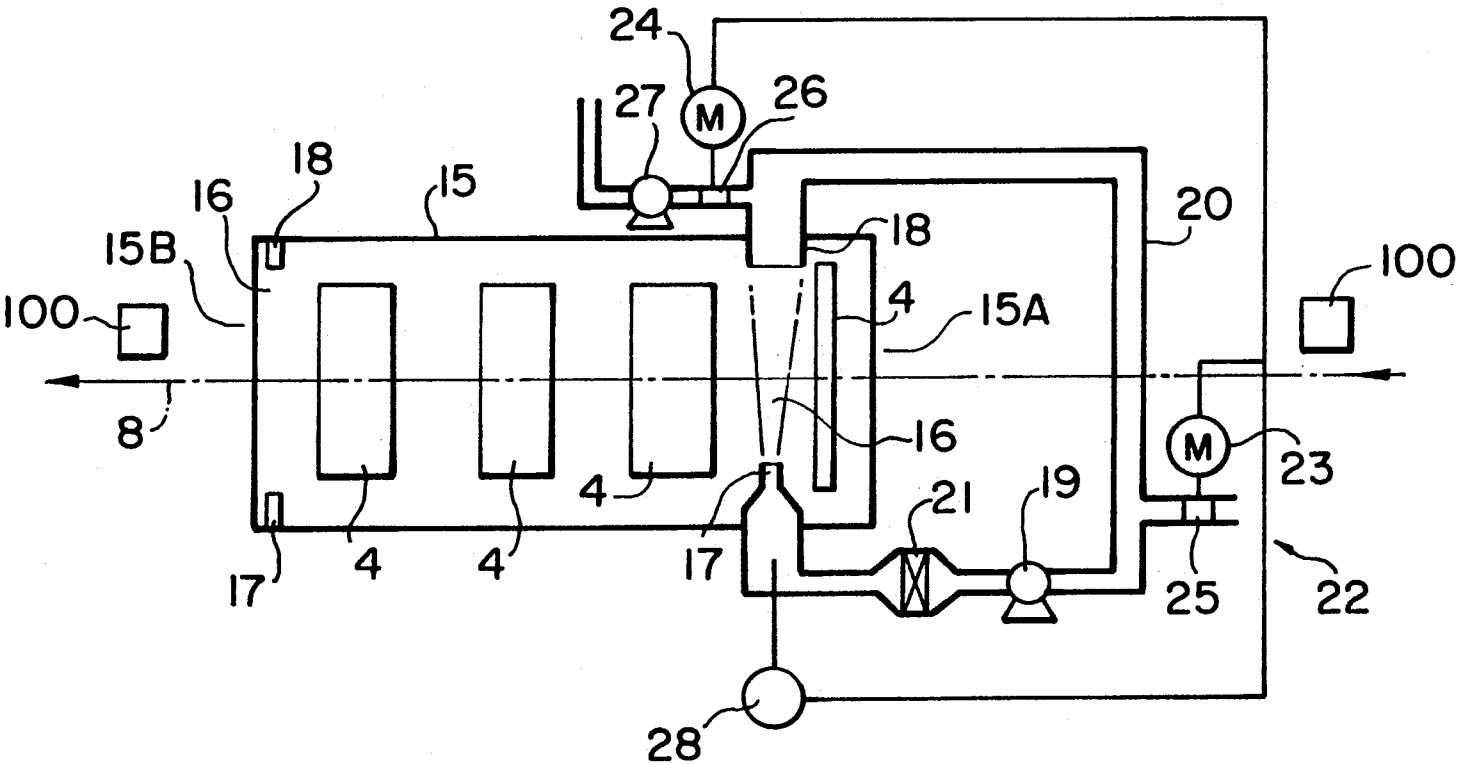
FIG. 18 is a schematically sectional view showing another example of a pre-heating furnace or a main heating furnace used in the embodiments B1, B2 and B3.

FIG. 17 and FIG. 18 show examples of tunnel shape furnace to be used for the pre-heating in the above described embodiments B1 to B3.

A tunnel shape furnace 15 shown in FIG. 17 included two inlet and outlet openings 15A and 15B through which the work 100 can be transported into and out of the furnace 15. Further the furnace 15 includes plurality of IR radiator mounting bank members 4 on the inside wall of the furnace 15. The bank member 4 is provided with plural IR radiators 3 inclinedly mounted thereon. The furnace 15 is provided with two sets of air curtain 16 at the inlet opening 15A and the outlet opening 15B. The air curtain 16 is defined between lower air port 17 and an upper air port 18 which are communicated with each other through a circulation duct 20. The duct 20 includes a fan 19 for ciculating the air from the upper air port 18 to the lower air port 17, a filter 21 arranged at the downstream rather than the fan 19 and an air cooling system 22.

The cooling system 22 includes two first and second modurate control motors 23 and 24, a first damper 25 set at the upperstream of the fan 19 and actuated by the first motor 23, a second damper 26 set by the upper air port 18 and actuated by the second motor 24, a temperature control unit 28 for detecting the temperature of the air blown from the lower air port 17 and controlling the motors 23 and 24.

Another tunnel shape furnace 15 shown in FIG. 18 is constituted in almost the same structure except that an additional IR radiator 3 or bank member 4 is set at the air curtain 16.

Figure 19:
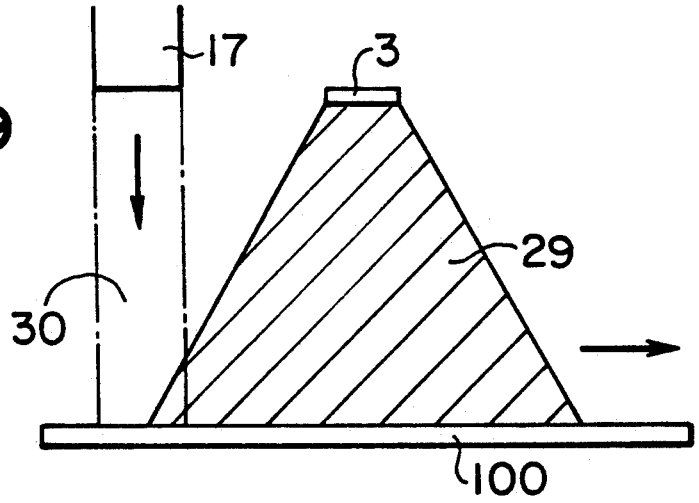
FIG. 19 is a partially enlarged illustration for explaining the infrared radiator used in the furnace shown in FIG. 18.

FIG. 19 shows a simplified illustration relating to the effective radiating area 29 of the IR beam radiated from the IR lamp 1 and the air blowing area 30 of the air curtain 16.

A typical operation of the tunnel shape furnace 15 shown in FIG. 17 will be described as follows.

The work 100 is transported into the furnace 15 through the inlet opening 15A. When the work 100 passes the air curtain 16, the work 100 is applied with the air blown from the lower air port 17. Since the air temperature is kept at a predetermined level by the cooling system 22, the layer surface of the work 100 is not hardened by the blowing air of the air curtain 16. In detail, assuming that the actual air temperature at the lower air port 17 is 110° C. which is detected by the temperature control unit 28, the actual air temperature in the furnace 15 is 160° C., the actual air temperature at the upper air port 18 is 130° C. and a predetermined temperature of the air blown from the air port 17, the control unit 28 outputs a command signal to the first and second modurate control motors 23 and 24 in order to correct the difference temperature of 30° C. between the actual temperature 110° C. and the predetermined temperature 80° C. The first motor 23 drives the damper 25 to open so that ambient air is introduced into the circulation duct 20. The second motor 24 also drives the damper 26 to open and the exhaust fan 27 to rotate so that the air is forcibly exhaust out of the circulation duct 20. When the temperature control unit 28 detects the actual temperature of the blowing air from the lower port 17 returns to the predetermined temperature level, the dampers 25 and 26 are fixed at their opening angles to keep the temperature of the air curtain 16 at the predetermined level.

In the tunnel shape furnace 15, the infrared radiation from the IR radiators 3 mounted on the banks 4 is applied to the work 100. The IR energy transmitted through the coated layer is absorbed by the substrate and changed to heating energy to heat the rear surface of the coated layer. The solvents of the coating material can be evaporated and the layer surface is not solidified by the air curtain 16 whose air temperature is controlled at the substantially same level. Thus the work surface can be prevented from generating pin holes.

In the furnace 15 as shown in FIG. 18 which includes the additional IR radiator 3 or bank member 4 set at the air curtain 16, the work 100 is applied with the infrared radiation immediately before the air curtain 16. This arrangement can shorten the drying period.

Table 9 shows the result of an experimental test on the generation of pin holes in the work surface using the tunnel shape furnaces shown in FIG. 17 and FIG. 18, wherein air velocity and air temperature of the air curtain are varied. According to this result, the air temperature of the air curtain is preferably kept at 80° C. or less in order to prevent the work surface from generating pin holes.

This experimental test was carried out under the following conditions.

Figure 20:
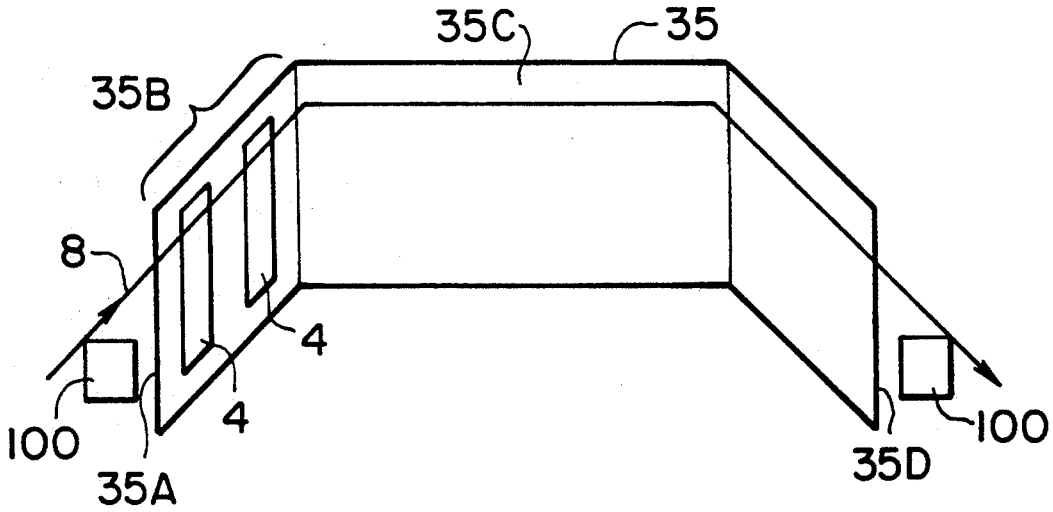
FIG. 20 is a schematically perspective illustration showing a drying device according to an embodiment C1 of the present invention.
Figure 21:
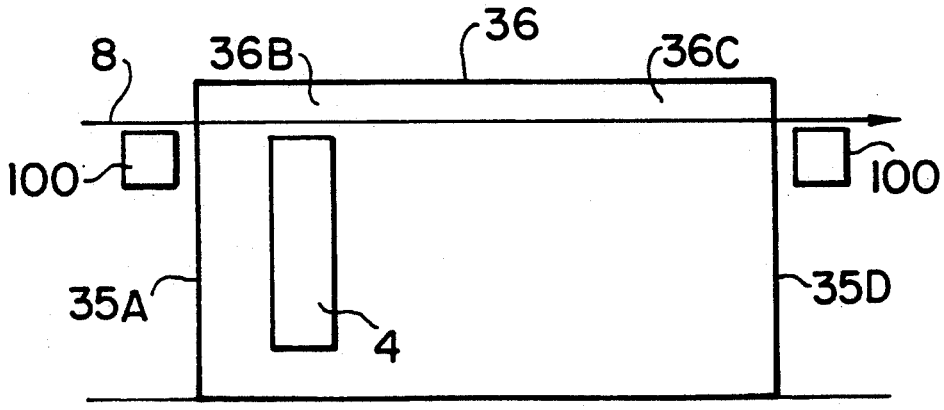
FIG. 21 is a schematical illustration showing a drying device according to an embodiment C2 of the present invention.

Coating Material: Melamine resin
Substrate: Bonderized steel plate 1.2 t
Layer Thickness: 30 μm
Room Temp.: 30° C.
Furnace Temp.: 160° C.
Height of Air Curtain (distance between the lower air port and the upper air port: 2 m
Air Velocity of Air Curtain (relation of the velocity at the upper air port to the velocity at the lower air port):
4 m/s to 10 m/s, 2.8 m/s to 7 m/s, 1.2 m/s to 4 m/s FIG. 20 and FIG. 21 show drying devices used in embodiments C1 and C2, respectively, in which pre-heating work and main heating work are carried out in the same furnace. The work 100 is subjected to the pre-heating work near the inlet opening of the furnace.

The embodiment C1 employs a camel back furnace which utilizes a combination of IR radiators generating far infrared radiation and blow of hot air as the main heating means. As shown in FIG. 20, the camel back furnace 35 includes an elevation section 35B adjacent to the inlet opening 35A on which plural banks 4 associated with IR radiators are mounted to act as the pre-heating work and a central section 35C associated with IR radiator generating near infrared radiation and/or a hot air blowing device to act as the main heating.

The embodiment C2 employs a tunnel shape furnace 36 which includes a bank 4 set section 36B on which IR radiators are mounted to act as the pre-heating work, adjacent to the inlet opening 36A and a central section 36C associated with IR radiator generating near infrared radiation and/or a hot air blowing device to act as the main heating.

In these furnaces, the work 100 is transported by a conveyor 8 through the pre-heating near the inlet opening of the furnace and the main heating. When the furnace uses the IR and hot air combination, the pre-heating and main heating period can be shortened.

Next, comparative experimental tests on drying efficiency of the coated layer by the drying method according to the present invention employing the pre-heating step using IR radiator generating near infrared radiation and the main heating step using IR radiator generating far infrared radiation and/or hot air blowing furnace and by a conventional drying method employing only a hot air furnace after coating step.

EMBODIMENT 3

A substitute, Bonderized steel plate (thickness 1 mm, dimension 100×100 mm), was provided with a layer (thickness 30 μm) of acrylic resin coating material (Acrylight 100; manufactured by Chiyoda Paint Co., Ltd) in a coating booth. The coated substrate, work 100, was transported in a tunnel shape furnace equipped with IR radiators generating near infrared radiation with output peak at 1.4 μm. The air temperature in the furnace was 150° C., the period for passing through the furnace was 3 min 30 sec, and the surface temperature of the work 100 was 50° C. Then the work 100 was set in a hot air furnace at 140° C. for 25 min.

The resulted work 100 had the hardness of a 2H degree pencil, density of 100/100, and no bubbles and no expansion.

COMPARATIVE EXAMPLE 3

A substitute, Bonderized steel plate (thickness 1 mm, dimension 100×100 mm), was provided with a layer (thickness 30 μm) of acrylic resin coating material (Acrylight 100; manufactured by Chiyoda Paint Co., Ltd) in a coating booth. The coated substrate, work 100, was set in a hot air furnace at 140° C. for 25 min.

The resulted work 100 had the hardness of a H degree pencil, density of 100/100, and bubbles and expansion of 20 bubbles/100 cm. Furthermore, comparative experimental tests on the drying efficiency of the coated layer by the drying method according to the present invention employing the pre-heating step after the first coating step, the second coating step after the pre-heating step and the main heating step using a hot air blowing furnace and by a conventional drying method employing only a hot air furnace after the first and second coating steps.

EMBODIMENT 4

A substitute, Bonderized steel plate (thickness 1 mm, dimension 100×100 mm), was provided with a layer (thickness 30 μm) of acrylic resin coating material (Acrylight 100; manufactured by Chiyoda Paint Co., Ltd) in a coating booth. The coated substrate, work 100, was transported in a tunnel shape furnace equipped with IR radiators generating near infrared radiation with output peak at 1.4 μm. The air temperature in the furnace was 150° C., the period for passing through the furnace was 2 min 30 sec, and the surface temperature of the work 100 was 60° C. Next, the substrate 100 was further provided with an additional layer (thickness 30 μm) of acrylic resin coating material (Acrylight 100; manufactured by Chiyoda Paint Co., Ltd). Then the work 100 was set in a hot air furnace at 210° C. for 40 min.

The resulted work 100 had no bubbles and no sagging. Fault product was 1% or less.

COMPARATIVE EXAMPLE 4

A substitute, Bonderized steel plate (thickness 1 mm, dimension 100×100 mm), was provided with a layer (thickness 30 μm) of acrylic resin coating material (Acrylight 100; manufactured by Chiyoda Paint Co., Ltd) in a coating booth. Next, the substrate 100 was further provided with an additional layer (thickness 30 μm) of acrylic resin coating material (Acrylight 100; manufactured by Chiyoda Paint Co., Ltd). The coated substrate, work 100, was set in a hot air furnace at 210° C. for 40 min.

The resulted work 100 had some bubbles and saggings. Fault product was about 10%, to be corrected.

As is clear from the above described experimental tests, it is appreciated that the solvents can be quickly evaporated and the bridging reaction starts at the preheating step in the drying method according to the present invention, thereby improving adhesiveness of the coated layer. Furthermore, the flowability between the substrate surface and the coated layer is also increased so that the secondary leveling at the bridging reaction can be improved. This makes the layer surface smooth and bright.

As many apparently widely different embodiments of this invention may be made without departing from the spirit and scope thereof, it is to be understood that the invention is not limited to the specific embodiments thereof except as defined in the appended claims.

TABLE 1

| Wave Length | Reflectance of Metals | | | | |
|---|---|---|---|---|---|
| (μm) | Au | Be | Cu | Mo | Ni |
| 0.25 | ... | 56 | 25.9 | ... | 47.5 |
| 0.30 | ... | 50 | 25.3 | ... | 41.5 |
| 0.35 | ... | ... | 27.5 | ... | 45.0 |
| 0.40 | 36.0 | 48 | 30.0 | 44.0 | 53.3 |
| 0.50 | 41.5 | 46 | 43.7 | 45.5 | 59.7 |
| 0.60 | 87.0 | ... | 71.8 | 47.6 | 64.5 |
| 0.70 | 93.0 | ... | 83.1 | 49.8 | 67.6 |
| 0.80 | ... | 50 | 88.6 | 52.3 | ... |
| 1.0 | ... | 54.5 | 90.1 | 58.2 | 74.1 |
| 2.0 | ... | ... | 95.5 | 81.6 | 84.4 |
| 4.0 | ... | ... | 97.3 | 90.5 | ... |
| 6.0 | ... | ... | 98.0 | 93.0 | ... |
| 8.0 | ... | ... | 98.3 | 93.7 | 96.0 |
| 10.0 | ... | ... | 98.4 | 94.5 | ... |
| 12.0 | ... | ... | 98.4 | 95.2 | ... |

TABLE 2

| Wave Length | Reflectance of Metals | | | |
|---|---|---|---|---|
| (μm) | Pd | Rh | Ag | Ta |
| 0.25 | ... | ... | 25 | ... |
| 0.30 | ... | ... | 13 | ... |
| 0.35 | ... | ... | 68 | ... |
| 0.40 | ... | ... | 87.5 | ... |
| 0.50 | ... | 76 | 95.2 | 38.0 |
| 0.60 | ... | ... | ... | 45.0 |
| 0.70 | ... | 79 | 96.1 | 56.0 |
| 0.80 | ... | 81 | 96.2 | 64.5 |
| 1.0 | 74.8 | 84 | 96.4 | 78.5 |
| 2.0 | ... | 91 | 97.3 | 90.5 |
| 4.0 | 88.1 | 92.5 | 97.7 | 93.0 |
| 6.0 | ... | 93.5 | 98.0 | 93.2 |
| 8.0 | 94.7 | 94 | 98.7 | 93.8 |
| 10.0 | 96.5 | 95 | 98.9 | 94.5 |
| 12.0 | 96.5 | ... | 98.9 | 95.0 |

TABLE 3

| Wave Length | Reflectance of Metals | | | | |
|---|---|---|---|---|---|
| (μm) | Al | Sb | Cd | Cr | Fe |
| 0.6 | ... | 53 | ... | 55.6 | 57.5 |
| 1.0 | 73.3 | 55 | 71.0 | 57.0 | 65.0 |
| 2.0 | 82.0 | 60 | ... | 63.0 | 78.0 |
| 3.0 | 88.3 | 65 | 93 | 70.0 | 84.5 |
| 4.0 | 91.4 | 68 | ... | 76.0 | 89.5 |
| 5.0 | 93.7 | ... | 95.9 | 81.0 | 91.5 |
| 6.0 | ... | 70 | ... | 85.0 | 93.0 |
| 7.0 | 95.0 | ... | ... | ... | 94.0 |
| 8.0 | 96.9 | ... | 97.2 | 89.0 | 94.0 |
| 9.0 | ... | 72 | 98.0 | 92.0 | 94.0 |
| 10.0 | 97.0 | ... | 98.0 | 93.0 | ... |
| 12.0 | 97.3 | ... | 98.2 | ... | ... |

TABLE 4

| Wave Length | Reflectance of Metals | | | |
|---|---|---|---|---|
| (μm) | Ir | Co | Mg | W |
| 0.6 | ... | ... | ... | 53.1 |
| 1.0 | 79.4 | 67.6 | 74.0 | 57.6 |
| 2.0 | ... | ... | 77.0 | 90.0 |
| 3.0 | 91.4 | 76.7 | 80.5 | 94.3 |
| 4.0 | 93.3 | 80.7 | 83.5 | 94.8 |
| 5.0 | 94.0 | 86.0 | 86.0 | 95.3 |
| 6.0 | 94.5 | ... | 88.0 | 95.8 |
| 7.0 | 94.7 | 98.0 | 91.0 | ... |
| 8.0 | 94.8 | 95.8 | 93.0 | ... |
| 9.0 | 95.5 | 96.4 | 93.0 | ... |
| 10.0 | 95.8 | 96.8 | ... | ... |
| 12.0 | 96.1 | 96.6 | ... | ... |

TABLE 5

| Counted Number of Pin Holes | | | |
|---|---|---|---|
| | Layer Thickness | | |
| Drying Conditions | 30 μm | 40 μm | 50 μm |
| 130° C. × 12 min | 0 | 0 | 0 |
| 140° C. × 10 min | 0 | 0 | 0 |
| 150° C. × 8 min | 0 | 0 | 0 |
| 160° C. × 6 min | 0 | 0 | 0 |
| 170° C. × 5 min | 0 | 0 | 10 |
| 180° C. × 4 min | 0 | 0 | 20 |

TABLE 6

| Counted Number of Pin Holes | | | |
|---|---|---|---|
| | Layer Thickness | | |
| Drying Condition | 30 μm | 40 μm | 50 μm |
| 130° C. × 12 min | 0 | 0 | 5 |
| 140° C. × 10 min | 0 | 3 | 10 |
| 150° C. × 8 min | 2 | 20 | Whole Surface |
| 160° C. × 6 min | 0 | Almost Whole Surface | Whole Surface |
| 170° C. × 5 min | Almost Whole Surface | Whole Surface | Whole Surface |
| 180° C. × 4 min | Whole Surface | Whole Surface | Whole Surface |

TABLE 7

| Counted Number of Pin Holes | | | |
|---|---|---|---|
| | Layer Thickness | | |
| Drying Condition | 30 μm | 40 μm | 50 μm |
| 130° C. × 12 min | 0 | 0 | 0 |
| 140° C. × 10 min | 0 | 0 | 0 |
| 150° C. × 8 min | 0 | 0 | 0 |
| 160° C. × 6 min | 0 | 0 | 0 |
| 170° C. × 5 min | 0 | 0 | 8 |

TABLE 7-continued

| Drying Condition | Counted Number of Pin Holes Layer Thickness 30 μm | 40 μm | 50 μm |
|---|---|---|---|
| 180° C. × 4 min | 0 | 0 | 25 |

TABLE 8

| Drying Condition | Counted Number of Pin Holes Layer Thickness 30 μm | 40 μm | 50 μm |
|---|---|---|---|
| 130° C. × 12 min | 0 | 0 | 10 |
| 140° C. × 10 min | 0 | 7 | 20 |
| 150° C. × 8 min | 0 | 15 | Almost Whole Surface |
| 160° C. × 6 min | 5 | 50 or more | Almost Whole Surface |
| 170° C. × 5 min | Almost Whole Surface | Whole Surface | Whole Surface |
| 180° C. × 4 min | Whole Surface | Whole Surface | Whole Surface |

TABLE 9

| Thinners for Melamine Resin and Acrylic Resin Coating Materials | Volume Ratio | Boiling Point (°C.) |
|---|---|---|
| Xylole | 10.9 | 140 |
| Isobutyl Alcohol | 1.0 | 108 |
| Methyl Methox Buthanole | 2.0 | 188 |

TABLE 10

| Thinners for Melamine Resin and Acrylic Resin Coating Materials (Thinners for Electrosatic Coating; No. 620, Manufactured by Daishin Chemical Co. Ltd.) | Volume Ratio | Boiling Point (°C.) |
|---|---|---|
| Xylole | 7.5 | 140 |
| Isobutyl Alcohol | 1.0 | 108 |
| Methyl Methox Buthanole | 2.0 | 188 |
| S150 Trimethyl Benzene | 3.5 | 200 |

TABLE 11

| Thinners for Melamine Resin and Acrylic Resin Coating Materials (Thinners for Electrosatic Coating; No. 1220, Manufactured by Daishin Chemical Co. Ltd.) | Volume Ratio | Boiling Point (°C.) |
|---|---|---|
| Xylole | 6.1 | 140 |
| Isobutyl Alcohol | 0.5 | 108 |
| Methyl Methox Buthanole | 1.5 | 188 |
| S150 Trimethyl Benzene | 5.0 | 200 |
| Butyl Carbidol | 1.0 | 230 |

TABLE 12

| Thinners for Urethane Resin Coating Materials | Wt. Part | Boiling Point (°C.) |
|---|---|---|
| Toluene | 30 | 110.63 |
| Xylene | 50 | 144.4 |
| Methyl Isobutyl Ketone | 10 | 115 |
| Ethyl 3-Ethoxpropinate | 10 | 170 |

TABLE 13

| Thinners for Fluoro Resin Coating Materials | Wt. Part | Boiling Point (°C.) |
|---|---|---|
| Toluene | 50 | 110.63 |

TABLE 13-continued

| Thinners for Fluoro Resin Coating Materials | Wt. Part | Boiling Point (°C.) |
|---|---|---|
| Xylene | 20 | 144.4 |
| Ethyl Acetate | 15 | 77.17 |
| Butyl Acetate | 5 | 117.26 |
| Methyl Isobutyl Ketone | 5 | 115 |
| Ethyl 3-Ethoxpropinate | 5 | 170 |

TABLE 14

| Thinners for Washing | Wt. % | Boiling Point (°C.) |
|---|---|---|
| Toluene | 60 | 111 |
| Acetone | 20 | 66 |
| Methanol | 20 | 64 |

TABLE 15

| Thinners for Melamine-Alkyd Coating Materials | Wt. % | Boiling Point (°C.) |
|---|---|---|
| Xylene | 80 | 140 |
| h-Buthanol | 10 | 117.7 |
| Methyl Ethyl Ketone | 5 | 79.6 |
| Butyl cell solve | 5 | 171 |

TABLE 16

| Thinners for Acrylic Resin Coating Materials | Wt. % | Boiling Point (°C.) |
|---|---|---|
| Toluene | 30 | 111 |
| Xylene | 50 | 140 |
| n-Buthanol | 5 | 117.7 |
| Ethyl Acetate | 5 | 77.17 |
| Butyl Acetate | 5 | 117.26 |
| Methyl Ethyl Ketone | 3 | 79.6 |
| Butyle cell solve | 2 | 171 |

TABLE 17

Dried Condition of Coated Layers of Various Thicknesses

| Temperature (°C.) | Time (min) | Layer Thickness (μm) | Bubbles | Hardness (Pencil) |
|---|---|---|---|---|
| 180° C. | 5 | 12~14 | ○ | H |
| | | 30 | X | H |
| 180° C. | 7 | 15~20 | ○ | 2H |
| | | 24~29 | ○ | H |
| 200° C. | 7 | 12~15 | ○ | 2H |
| | | 31~38 | X | H~ |
| 200° C. | 7 | 20~24 | ○ | 2H |
| | | 45~50 | X | H |

Epoxy Resin Coated Material
(Epico 1000 manufactured by Nihon Yushi Co. Ltd.)
Substrate: Bonderized Steel Plate 1.6 mm thick
○ → No Bubbles
X → Bubbles

What is claimed is:

1. A method for drying a first coated layer formed on a substrate comprising the steps of:

a) applying a first infrared radiation to the coated layer, the first infrared radiation having a high transmissivity relative to the coated layer and a high absorptivity relative to the substrate;

b) allowing said substrate to be heated by a portion of the first infrared radiation which is absorbed by the substrate;

c) heating a rear surface of the coated layer due to its interface with the heated substrate such that any solvents in the coated layer are evaporated prior to a complete drying and hardening of the coated layer;

d) applying a second infrared radiation to the coated layer, the second infrared radiation having a high absorptivity relative to the coated layer such that the coated layer is hardened without having any pin holes or bubbles therein.

2. A method for drying as recited in claim 1, further comprising the step of blowing hot air against the coated layer concurrently with step d).

3. A method for drying as recited in claim 1, wherein the first infrared radiation has an energy peak at <2 μm, the substrate is made from one of iron, aluminum, copper, brass, gold, beryllium, molybdenum, nickel, lead, rhodium, silver, tantalum, antimony, cadmium, chromium, iridium, cobalt, magnesium, and tungsten, and the coated layer is made from one of acrylic resin, urethane resin, epoxy resin, melamine resin, and so on.

4. A method for drying as recited in claim 1, wherein the second infrared radiation applied has an energy peak at 1.3 to 20 μm.

5. A method for drying as recited in claim 2, further comprising blowing hot air against the coated layer during step c), the hot air being blown during step a) having a lower temperature than a temperature of the hot air blown during step d).

6. A method for drying as recited in claim 5, further comprising applying a third infrared radiation which is the same as the first infrared radiation to the coated layer while concurrently blowing hot air at a temperature between the respective temperature of the hot air blown during step c) and step d).

7. A method for drying as recited in claim 3, wherein the first infrared radiation has an energy peak in a range from 1.2 μm to 1.5 μm.

8. A method for drying as recited in claim 4, wherein the second infrared radiation applied has an energy peak at 2.5 μm when said coated layer is a melamine resin or an acrylic resin.

9. A method for drying as recited in claim 4, wherein the second infrared radiation applied has an energy peak at 5.6 μm when said coated layer is a urethane resin.

10. A method for drying as recited in claim 4, wherein the second infrared radiation applied has an energy peak at between 7 to 8 μm when the coated layer is a silicon resin.

11. A method for drying as recited in claim 1, wherein a second coated layer is applied over the first coated layer subsequent to step a) and prior to step d).

12. A drying device for a coated layer formed on a substrate, said device comprising:

a housing;

a first infrared radiator disposed in the housing which generates a first infrared radiation onto the coated layer, the first infrared radiation having a high transmissivity relative to the coated layer and a high absorptivity relative to the substrate;

means for heating the substrate including a transmitted portion of the first infrared radiation;

means for heating the coated layer at an interface of the coated layer and the heated substrate, said coated layer heating means including said heated substrate;

means for evaporating any solvents in the coated layer prior to hardening the coated layer, said evaporating means including said substrate heating means and said coated layer heating means; and a second infrared radiator which generates a second infrared radiation onto the coated layer, the second infrared radiation having a high absorptivity relative to the coated layer such that the coated layer is hardened;

means for hardening the coated layer including said second infrared radiator and said second infrared radiation.

13. A drying device as recited in claim 12, wherein the first infrared radiation has an energy peak at 2 μm, the substrate is made from one of iron, aluminium, copper, brass, gold, beryllium, molybdenum, nickel, lead, rhodium, silver, tantalum, antimony, cadmium, chromium, iridium, cobalt, magnesium, and tungsten, and the coated layer is made from one of acrylic resin, urethane resin, epoxy resin, and melamine resin.

14. A drying device as recited in claim 12, wherein the energy peak is in a range of 12 μm to 1.5 μm.

15. A drying device as recited in claim 12, wherein the first infrared radiator includes a plurality of infrared radiators which are disposed in an inclined position within the housing, and the second infrared radiator includes a second plurality of infrared radiators which are each disposed in an inclined manner in the housing.

16. A drying device as recited in claim 12, wherein the first infrared radiator includes a first plurality of infrared radiators, the second infrared radiators include a second plurality of infrared radiators, and the first plurality of infrared radiators are spaced apart from each other at a greater distance than the second plurality of infrared radiators are spaced from each other.

* * * * *